United States Patent [19]

Bock

[11] 4,054,197

[45] Oct. 18, 1977

[54] GOLF BALL VENDOR

[76] Inventor: Oscar Bock, Bock Corp., P. O. Box 551, Madison, Wis. 53701

[21] Appl. No.: 726,066

[22] Filed: Sept. 24, 1976

[51] Int. Cl.[2] ..... G07F 11/00

[52] U.S. Cl. ..... 194/57; 221/202

[58] Field of Search ..... 194/57, 58; 221/263, 221/277, 200, 202, 203

[56] References Cited

U.S. PATENT DOCUMENTS

| | | | |
|---|---|---|---|
| 3,175,669 | 3/1965 | Garvin | 221/202 X |
| 3,946,847 | 3/1976 | Bock | 194/57 |

*Primary Examiner*—Stanley H. Tollberg
*Attorney, Agent, or Firm*—John M. Winter; Theodore J. Long; Harry C. Engstrom

[57] ABSTRACT

A coin-controlled, manually operable machine for vending several dozen golf balls at a time. The vending machine has a ball hopper and a ramp below the hopper defining a ball dispensing opening between them. A gate rotatably mounted at the opening, extends partially there across in its closed position to cause the balls to bridge the opening. When the double-stroke actuating lever is pulled forward and returned, the gate is swung or kicked into the mass of balls twice to break up the bridging of balls to release a sufficient excess of balls down the ramp to assure filling of a rotatable ball receiver-dumper cylinder extending across the bottom of the ramp. The actuating lever is maintained inoperative by a coin-releasable locking mechanism. The receiver-dumper cylinder has a keeper slot receiving a limiting lug.

7 Claims, 10 Drawing Figures

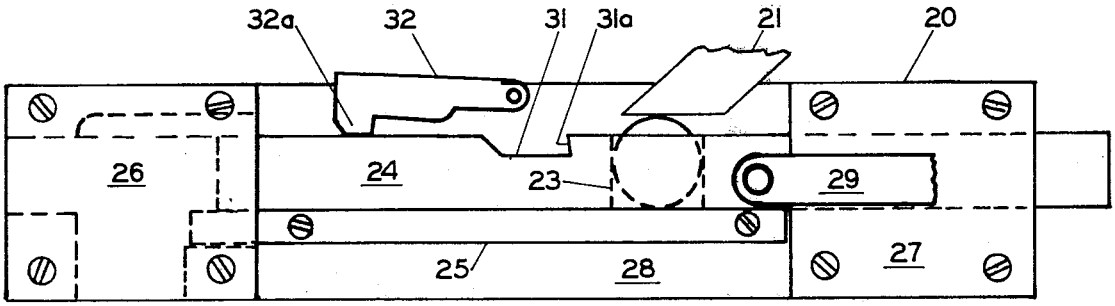
FIG. 6
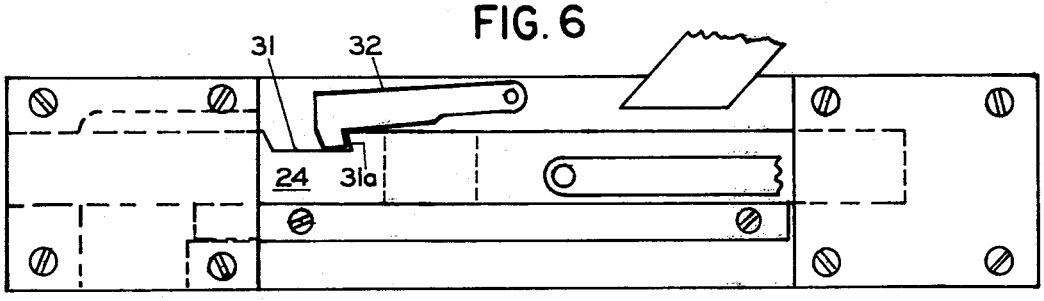
FIG. 7
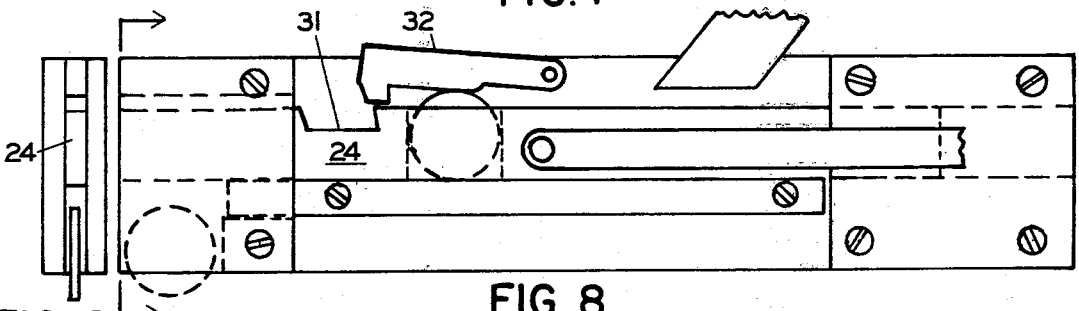
FIG. 8
FIG. 9
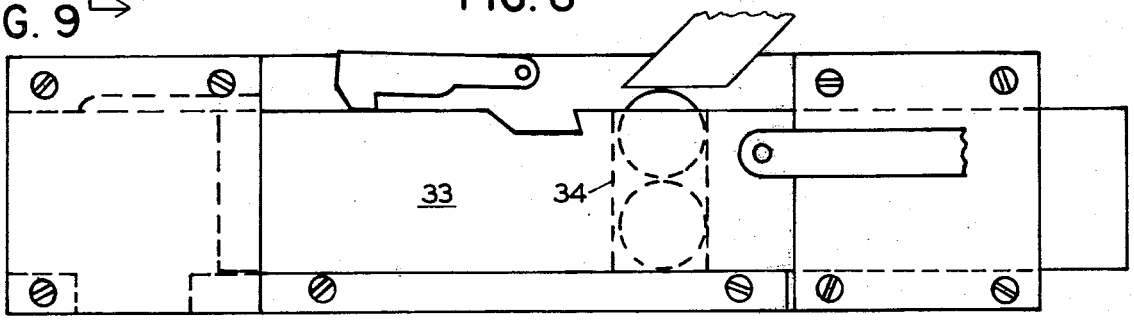
FIG. 10

GOLF BALL VENDOR

BACKGROUND OF THE INVENTION

This invention relates to machines for dispensing a predetermined number of spherical articles from a hopper and more particularly to a golf ball vending machine.

DESCRIPTION OF THE PRIOR ART

Presently, the most widespread manner of dispensing golf balls for practice at golf courses and driving ranges is for an attendant in the pro shop to rent a "bucket" of golf balls to the golfer by handing a previously filled bucket to the golfer in exchange for payment. Although widespread, this is recognized from both the operator's and the customer's point of view as a somewhat bothersome and inefficient way of handling the transaction.

This invention is an improvement on the golf ball vending machine shown in my U.S. Pat. No. 3,946,847. My earlier machine is somewhat limited to the faithful dispensing of a relatively small number of balls each time the actuator lever is pulled because the balls tend to bridge across the opening fairly quickly after the gate or "bridge buster" is kicked into the mass of balls. While my earlier machine is fine for "warm up" immediately before and while awaiting "tee time", the dispensing of a much larger number of balls is desired for the common longer practice sessions.

SUMMARY OF THE INVENTION

I have invented a new and improved golf ball vending machine which is coin-controlled and manually operated by the customer to faithfully dispense a predetermined large number of balls from a hopper in a simpler and more efficient manner than known machines. My vendor which comprises only mechanical systems is simple, compact, and wheel portable so that it can be stored in the evenings to prevent vandalism and moved about to any location where it is needed.

The vendor has a large ball hopper with a ramp extending below the hopper to define a ball dispensing opening. A combination gate and "bridge buster" is positioned at the opening which causes balls to bridge across the opening in its closed position and breaks up the bridging as it is swung into the mass of balls for releasing balls down the ramp to a ball receiverdumper cylinder extending across the bottom end of the ramp. The gate is kicked into the mass of balls on the forward pull of the actuator lever and again on the return stroke to release a sufficient excess of balls down the ramp to assure filling of the ball receiver when the operating lever is returned to its starting position.

In conjunction with the much greater number of balls dispensed, a new and improved mechanism was invented to permit the use of more than one coin to pay for the larger number of balls and to provide a simpler gravity coin drop.

Further objects, features and advantages of my golf ball vendor will be apparent from the following detailed description taken in conjunction with the accompanying drawings showing a preferred embodiment of my invention for exemplification.

BRIEF DESCRIPTION OF THE DRAWINGS

FIG. 6 is a side elevation view of the coin-releasing locking mechanism in its coin receiving position, with portions thereof shown in phantom.

FIG. 7 is a side elevation view of the locking mechanism shown in its locked position.

FIG. 8 is a side elevation view of the locking mechanism released by a coin.

FIG. 9 is a side elevation view of the locking mechanism in its coin dropping position.

FIG. 10 is a side elevation view of a second embodiment of the coin-releasing locking mechanism for operation with two coins.

DESCRIPTION OF A PREFERRED EMBODIMENT

Figure 1:
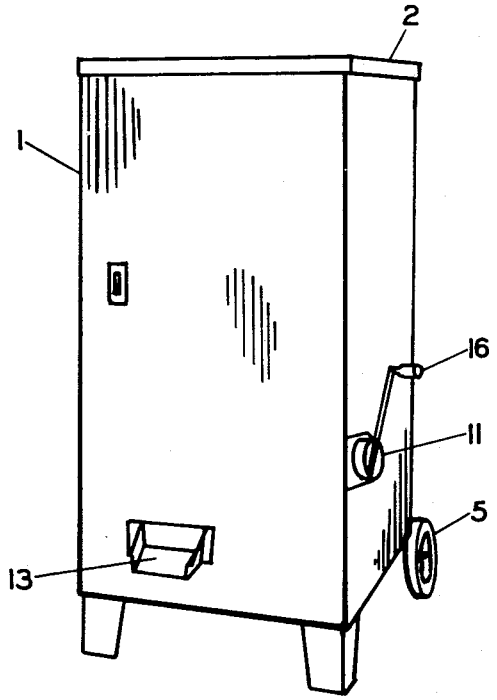
FIG. 1 is a perspective view of the front and one side of a golf ball vendor constructed in accordance with the present invention.

Referring now more particularly to the drawings wherein like numerals refer to like parts throughout the several views, my golf ball vendor is generally shown in FIG. 1.

Figure 2:
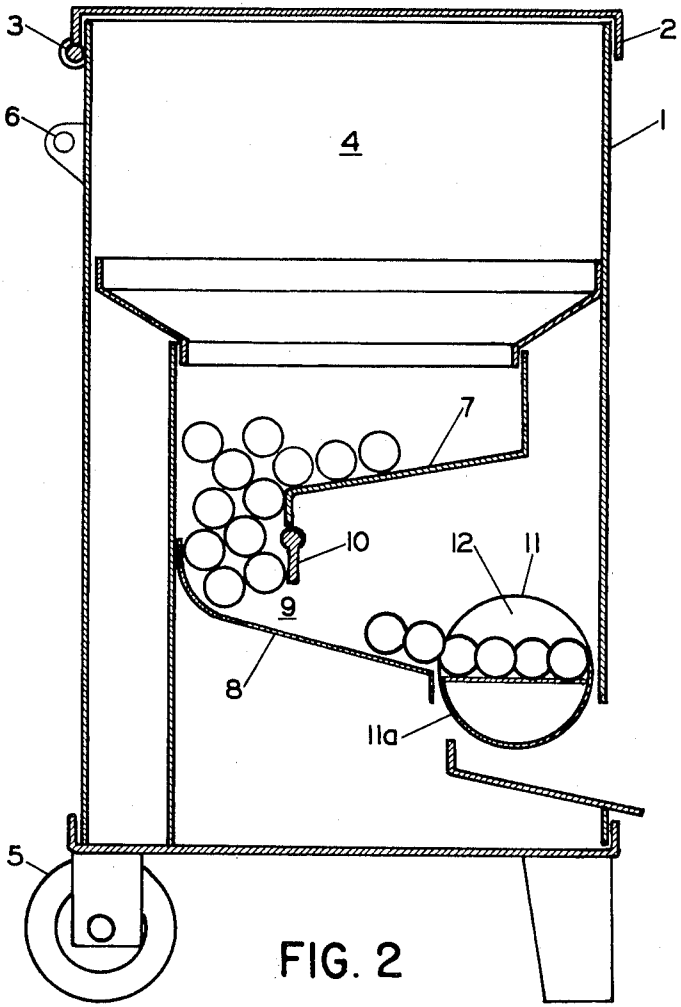
FIG. 2 is a schematic section view showing the ball path through the vendor with the ball receiver-dumper cylinder in its ball receiving position.

Referring to FIG. 1 and 2, the vendor has a cabinet 1 with a top cover 2 hinged at 3 for access to the ball hopper 4 which preferably has a capacity to hold approximately 4,000 –5,000 golf balls. The vendor is wheel supported at 5 and has a handle bar 6 for tipping the vendor rearwardly to facilitate moving.

The ball hopper 4 is tapered and has a rearwardly declining bottom pan 7. A forwardly declining ramp 8 extends below the pan 7 in spaced relation so as to provide a ball dispensing opening 9 therebetween.

Figure 3:
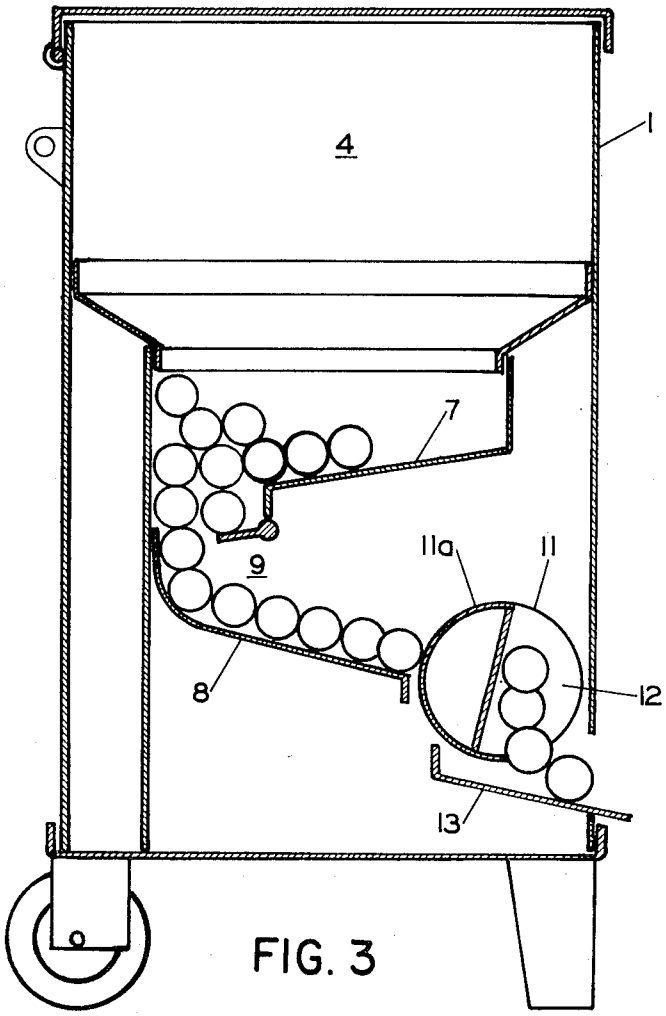
FIG. 3 is a schematic section view showing the ball path through the vendor with the ball receiver-dumper cylinder in its ball dumping position.
Figure 4:
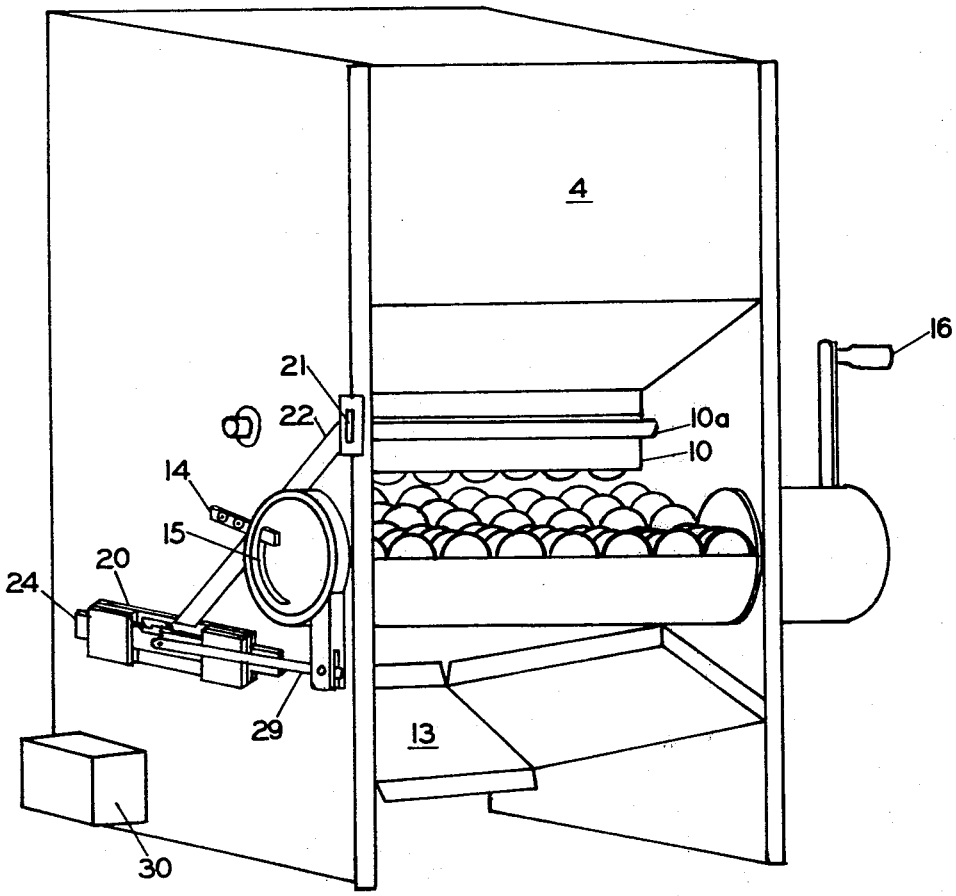
FIG. 4 is a perspective view of the vendor with the cabinet removed to show the working mechanisms.

A gate 10 is rotatably mounted across the ball opening 9 as shown in FIGS. 2 –4. As best seen in FIG. 2, the gate, in its closed position, extends downwardly to a point more than a diameter of one ball but less than the diameter of two balls from the ramp 8 which causes the balls to bridge the opening and thereby stop the flow of balls therethrough. The gate is pivotable about 90 °into the mass of balls in the hopper to a release or kick position shown in FIG. 3 to break up the bridged mass of balls at the opening and to loosen the mass of balls throughout the hopper to maintain flow as desired. The ramp is preferably curved to facilitate the slightly backward and upward movement of the balls therealong as the gate is swung rearwardly to its ball release position.

Balls released through the opening 9 roll down the ramp 8 onto a rotatably journalled, ball receiver-dumper 11 extending across the lower end of the ramp. The ball receiver-dumper cylinder 11 is semi-cylindrical intermediate its ends, having an open ball receptable 12 formed therein for receiving balls from that ramp when in its ball receiving position shown in FIG. 2. The ball receptable is sized for the desired number of balls; in the case shown, four rows of eight, or thirty-two balls.

The rear surface 11a of the ball receiver-dumper 11 rotatably trails across the lower end of the ramp 8 to hold the balls on the infeed ramp 8 as the ball receiver-dumper is rotated forwardly about 105 °to its dumping position depicted in FIG. 3. In this position, the balls spill onto the delivery pan 13 for exit from the vendor. As shown in FIG. 4, the rotation of the ball receiver-dumper cylinder 11 is limited by a lug 14 which is received in a keeper slot 15 found on the cylinder. This construction also restricts the lateral movement of the cylinder and parts connected thereto.

Figure 5:
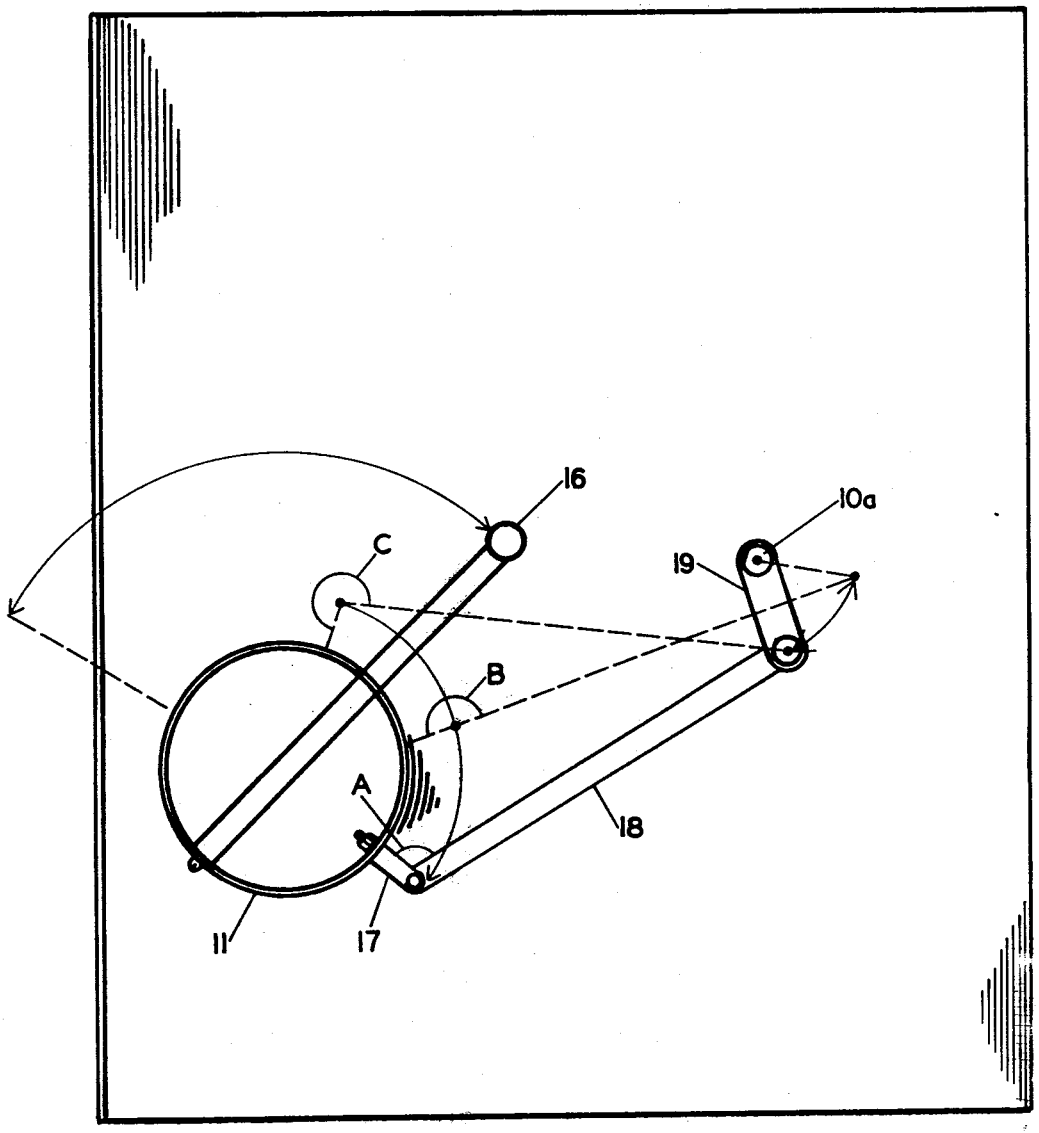
FIG. 5 is a right side elevation view of that portion of the vendor shown in FIG. 4 schematically depicting the operation of the actuating lever and linkage arms.

Referring now to FIGS. 2 and 5, the vendor is operated by a manually movable double-stroke actuating lever 16 which is fixedly attached to and extends through the end of the ball receiver-dumper cylinder 11. The cylinder is connected by mechanical linkage to the protruding journal bar 10*a* of the gate 10. The linkage comprises a short first arm 17 fixedly attached to and extending radially from the ball receiver-dumper cylinder, an elongate second arm 18 pivotally pinned at one end to arm 17, and a third short arm 19 pivotally pinned at one end to the other end of am 18 and fixedly attached at its other end to the protruding journal bar 10a for rotating the gate.

When the actuating lever 16 is in its rear starting position shown in FIG. 4, the ball receiving-dumper cylinder is in its ball receiving position and gate 10 is in its downwardly extending closed position shown in FIG. 2. In this position, arms 17 and 18 form an obtuse angle A therebetween. When the actuating lever 16 is pivoted forwardly about 105 °as depicted in dashed lines in FIG. 5, the arm 17 and 18 pass through a straight angular relation shown at B wherein the arm 19 is pivoted upwardly and rearwardly causing the gate 10 to be pivoted into its release position shown in FIG. 3. As the actuating lever completes its forward stroke, arms 17 and 18 are pivoted into a reflex angular relation shown at C in FIG. 5 which causes the arm 19 to be pivoted back to its position shown in full lines and thus returning the gate 10 to its closed position shown in FIG. 2. The ball receiver-dumper cylinder 11 is in its dumping position shown in FIG. 3 when the actuating lever arm 16 is in its full forward position. On the return stroke of the doublestroke actuating lever 16, the arms 17 and 18 change from the reflex angular relation shown at C through the straight angular relation shown at B back to the obtuse angular relation shown at A whereby the gate 10 is correspondingly pivoted from its closed position to its release position and back again to its closed position while the ball receiver-dumper cylinder 11 is returned to its ball receiving position. This double kick action of the gate 10, of course, provides the release of a sufficient excess of balls from the hopper 4 to the ball ramp 8 to assure complete filling of the ball receiver-dumper cylinder. A return spring (not shown) may be provided for returning the actuating lever 16 to its rearward starting position.

Referring to FIGS. 4, and 6 –9, the vendor is coincontrolled in that it has a coin-releasable locking mechanism shown generally at 20 in FIG. 6. The vendor has a forwardly open coin slot 21 and a rearwardly declining coin chute 22 for carrying a coin of predetermined denomination to a coin pocket 23 formed in the inner face of a slide bar 24 and over base bar 25. The slide bar is mounted for rectilinear movement above base bar 25 by a pair of mounting plates 26 and 27 and a backing plate 28. The ball receiver-dumper cylinder 11 has linkage shown at 29 connecting it to the slide bar for moving the slide bar sequentially from a coin receiving position shown in FIG. 6, to a locking position shown in FIG. 7, to a coin dropping position shown in FIG. 9. A notch 31 is formed in the upper edge of the slide bar and provides a shoulder 31*a*. A gravity drop latch 32 has a hook portion 32*a* for dropping into the notch and engaging said shoulder when the slide bar is moved from its coin receiving position, FIG. 6, into locking position when no coin is present in the coin pocket of the slide bar as depicted in FIG. 7. When a coin of the predetermined size is present in the coin pocket as shown in FIG. 8, the coin engages the drop latch and prevents the hooked portion thereof from dropping into the notch thus permitting the slide bar to move through the locking position into the coin dropping position and permitting the ball receiver-dumper cylinder 11 to thus be rotated into its dumping position. In the coin dropping position, the coin pocket in the slide bar is positioned beyond the front end of the base member 25 so that the coin drops by gravity into a coin box 30 shown in FIG. 4. The slide bar, of course, is returned to its coin receiving position when actuating lever 16 is returned to its starting position.

FIG. 10 shows a modified form of the coin-releasable locking mechanism for accommodating the use of two or more coins. In this embodiment, the slide bar 33 is of greater height to provide a deeper coin pocket 34 for receiving two or more coins of predetermined sie in edgewise stacked relation so that the top coin in the stack engages the drop latch and prevents it from locking the slide bar.

It is understood that my invention is not confined to a particular construction and arrangement of parts herein illustrated and described, but embraces all such modified forms as come within the scope of the following claims.

I claim:

1. A golf ball vendor comprising:

a. a ball hopper having an bottom pan;

b. a declining ramp extending below said hopper bottom pan in spaced relation thereto, said pan and ramp defining a ball dispensing opening there between;

c. a gate pivotably mounted below said hopper pan and above said discharge ramp at said opening rotatable between (1) a downwardly extending closed position wherein the lower edge of said gate is spaced more than the diameter of one ball and less than the diameter of two balls from said ramp to cause said balls in said hopper to bridge across said opening and (2) a release position into which said gate is swung toward the mass of balls in said hopper to break up the bridging of balls therein for releasing balls down said ramp;

d. ball receiver-dumper extending across the lower end of said declining ramp, said ball receiver being rotatable between a receiving position and a dumping position for receiving a predetermined number of balls from said ramp and dumping them; and e. manually movable double stroke actuating means operatively linked to said ball receiver-dumper and said gate for (1) rotating said ball receiver-dumper from its receiving position to its dumping position for dumping balls therefrom and for rotating said gate from said closed position to said release position back to said closed position, by a single operating stroke of said actuating means, and (2) rotating said ball receiver-dumper from its dumping position back to its receiving position and said gate from its closed position to said release position and back to its closed position by a single return stroke of said actuating means.

2. The golf ball vendor as specified in claim 1 wherein said manually movably double stroke actuating means is fixedly attached to said rotatable ball receiver-dumper, and where said vendor has linkage comprising a first arm rigidly mounted on said ball receiver-dumper, a second arm pinned at one end to first arm, a third arm pinned at one end to the other end of said second arm, and said third arm being fixedly attached at its other end to said pivotable gate, said first and second arm forming an obtuse angle therebetween when said ball receiver-dumper is in said receiving position and passing through a straight angular relation to a relfex angular relation when said ball receiver-dumper is rotated from its receiving position to its dumping position by a single stroke of said actuating arm causing said gate to pivot from its closed position to its release position and back to its closed position, on the return stroke of said double stroke actuating means said first and second arms changing from a reflex angular relation through a straight angular relation back to an obtuse angular relation when said ball receiver-dumper is rotated back from its dumping position to its ball receiving position causing said gate to again pivot from its closed position to its release position and back to its said closed position.

3. The golf ball vendor as specified in claim 1 wherein said ball receiver-dumper has a curved surface thereon rotatable across the lower end of said ramp to block balls thereon as said ball receiver is rotated from its receiving position to its dumping position.

4. The golf ball vendor as specified in claim 1 comprising a fixedly mounted limiting lug and wherein said ball receiverdumper has a keeper slot formed therein receiving said lug for limiting the rotation and lateral movement of said ball receiverdumper.

5. The golf ball vendor as specified in claim 1 having a coin-releasable locking mechanism for preventing operation of said manually movable actuating means.

6. The golf ball vendor as specified in claim 5 wherein said coin-releasable locking mechanism comprises:

a. a slide bar mounted for rectilinear movement sequentially from a coin receiving position, to a locking position, to a coin dropping position, and return; said slide bar having (1) a coin pocket formed therein for receiving a coin of predetermined size through the top thereof, and (2) a notch formed in the upper edge of said slide bar providing a shoulder on said slide bar;

b. a stationary base member below said slide bar, said base member forming a bottom for said coin pocket and having an end;

c. a drop latch having a hook portion for dropping into said notich and engaging said shoulder when said slide bar is moved from said coin receiving position to said locking position in the absence of a coin in the coin pocket of said slide bar, when a coin of the predetermined size is present in said coin pocket as said slide bar is moved from said coin receiving position toward said locking position said coin engages said drop latch and prevents the hook portion thereof from dropping into said notch permitting said slide bar to move through said locking position to said coin releasing position; and d. means linked to said manually movable actuating means for (1) sliding said slide bar from said coin receiving position to said locking position before said ball receiver-dumper reaches its ball dumping position when no coin is present in the coin pocket of said slide bar, and (2) sliding said slide bar beyond said locking position when a coin is present in said coin pocket to carry said coin pocket beyond the end of said stationary base member when the notch in said slide bar has cleared said drop latch so that said coin falls by gravity out of said coin pocket.

7. The golf ball vendor as specified in claim 5 wherein said coin-releasable locking mechanism comprises:

a. a slide bar mounted for rectilinear movement sequentially from a coin receiving position, to a locking position, to a coin dropping position, and return; said slide bar having (1) a coin pocket formed therein for receiving a plurality of coins of predetermined size in edgewise stacked relation through the top thereof, and (2) a notch formed in the upper edge of said slide bar providing a shoulder on said slide bar;

a stationary member below said slide bar, said stationary member forming a bottom for said coin pocket and having an end;

c. a drop latch having a hook portion for dropping into said notch and engaging said shoulder when said slide bar is moved from said coin receiving position to said locking position in the absence of a selected number of edgewise stacked coins in the coin pocket of said slide bar, when a selected number of coins of the predetermined size are present in said coin pocket as said slide bar is moved from said coin receiving position toward said locking position the top coin in said coin pocket engages said drop latch and prevents the hook portion thereof from dropping into said notch permitting said slide bar to move through said locking position to said coin dropping position; and d. means linked to said manually movable actuating means for (1) sliding said slide bar from said coin receiving position to said locking position before said ball receiver-dumper reaches its ball dumping position when the selected number of edgewise stacked coins is present in the coin pocket of said slide bar and (2) sliding said slide bar beyond said locking position to said coin releasing position when the selected number of edgewise stacked coins is present in said coin pocket to carry said coin pocket beyond the end of said stationary base member when the notch in said slide bar has cleared said drop latch so that said coins fall by gravity out of said coin pocket.

* * * * *